US009917370B2

(12) United States Patent
McGough et al.

(10) Patent No.: US 9,917,370 B2
(45) Date of Patent: Mar. 13, 2018

(54) DUAL-BAND PRINTED OMNIDIRECTIONAL ANTENNA

(71) Applicant: Cisco Technology, Inc., San Jose, CA (US)

(72) Inventors: Erin Patrick McGough, Akron, OH (US); Thomas Goss Lutman, Cuyahoga Falls, OH (US)

(73) Assignee: Cisco Technology, Inc., San Jose, CA (US)

( * ) Notice: Subject to any disclaimer, the term of this patent is extended or adjusted under 35 U.S.C. 154(b) by 644 days.

(21) Appl. No.: 14/245,171

(22) Filed: Apr. 4, 2014

(65) Prior Publication Data

US 2016/0294063 A1 Oct. 6, 2016

(51) Int. Cl.

| | |
|---|---|
| ***H01Q 9/06*** | (2006.01) |
| ***H01Q 9/28*** | (2006.01) |
| ***H01Q 21/00*** | (2006.01) |
| ***H01Q 5/00*** | (2015.01) |
| ***H01Q 1/50*** | (2006.01) |
| ***H01Q 21/30*** | (2006.01) |
| ***H01Q 5/371*** | (2015.01) |

(52) U.S. Cl.

CPC ..... *H01Q 9/065* (2013.01); *H01Q 1/50* (2013.01); *H01Q 5/371* (2015.01); *H01Q 9/28* (2013.01); *H01Q 21/00* (2013.01); *H01Q 21/30* (2013.01)

(58) Field of Classification Search

CPC .... H01C 9/0457; H01C 9/065; H01C 21/062; H01C 5/371

See application file for complete search history.

(56) References Cited

U.S. PATENT DOCUMENTS

| | | | | |
|---|---|---|---|---|
| 3,845,490 | A * | 10/1974 | Manwarren | H01P 5/1007 333/238 |
| 4,477,813 | A * | 10/1984 | Weiss | H01Q 21/065 343/700 MS |
| 4,800,393 | A * | 1/1989 | Edward | H01Q 9/065 333/26 |
| 4,847,625 | A * | 7/1989 | Dietrich | H01Q 9/0457 343/700 MS |
| 8,108,020 | B2 | 1/2012 | Anderson et al. | |
| 8,242,969 | B2 | 8/2012 | Lutman et al. | |
| 8,519,893 | B2 | 8/2013 | Lutman et al. | |
| 2004/0012534 | A1 | 1/2004 | Dai et al. | |

(Continued)

OTHER PUBLICATIONS

International Search Report and Written Opinion in counterpart International Application No. PCT/US2015/023765, dated Jul. 1, 2015, 8 pages.

(Continued)

*Primary Examiner* — Daniel J Munoz

(74) *Attorney, Agent, or Firm* — Edell, Shapiro & Finnan, LLC

(57) ABSTRACT

A microwave antenna assembly is printed on a substrate with a first face and an opposing second face. The assembly includes at least one antenna disposed on the front face of the substrate and a balun disposed on the rear face of the substrate. A first microstrip on the front face is coupled to the antenna(s). A second microstrip on the front face is coupled a feed line. A coplanar strip on the rear face is electrically coupled to the second microstrip and electromagnetically coupled to the first microstrip.

14 Claims, 12 Drawing Sheets

(56) References Cited

U.S. PATENT DOCUMENTS

| | | | | |
|---|---|---|---|---|
| 2004/0041732 | A1* | 3/2004 | Aikawa | H01Q 9/0457 343/700 MS |
| 2005/0110698 | A1* | 5/2005 | Surducan | H01Q 1/38 343/795 |
| 2007/0040759 | A1* | 2/2007 | Lee | H01Q 1/38 343/795 |
| 2009/0121947 | A1 | 5/2009 | Nysen | |
| 2009/0140927 | A1* | 6/2009 | Maeda | H01Q 9/0407 343/700 MS |
| 2011/0210899 | A1* | 9/2011 | Aoki | H01Q 5/0062 343/749 |
| 2012/0013521 | A1 | 1/2012 | Saliga et al. | |
| 2012/0127051 | A1 | 5/2012 | Chiu et al. | |
| 2014/0062822 | A1* | 3/2014 | Tseng | H01Q 21/26 343/798 |

OTHER PUBLICATIONS

Kim et al., "A Novel Balun with Vertically Periodic Defected Ground Structure", Tencon 2006. 2006 IEEE Region 10 Conference, Nov. 17, 2006, 4 pages.

Zhang et al., "Compact printed dual-band dipole with wideband integrated balun", Electronics Letters, vol. 45—No. 24, Nov. 19, 2009, 2 pages.

Lindberg et al., "Dual wideband printed dipole antenna with integrated balun", IET Microw. Antennas Propag., vol. 1—No. 3, Jun. 2007, 5 pages.

He et al., "Wideband and Dual-Band Design of a Printed Dipole Antenna", Antennas and Wireless Propagation Letters, IEEE, vol. 7, Feb. 2008, 4 pages.

* cited by examiner

DUAL-BAND PRINTED OMNIDIRECTIONAL ANTENNA

TECHNICAL FIELD

The present disclosure relates to omnidirectional antennas printed on substrates.

BACKGROUND

In an increasingly connected world, users try to find constant wireless network connectivity for their electronic devices. A user typically connects his device to a wireless network through wireless network access points. In order to maximize the utility of the wireless network, wireless network access points typically use omnidirectional antennas tuned to specific frequencies according to the IEEE 802.11 standards. More advanced wireless networks may include Multiple Input Multiple Output (MIMO) access points that include multiple sets of antennas. A MIMO access point imposes constraints on the size and materials of each individual antenna element.

A MIMO access point may include multiple antennas printed on a low permittivity substrate. Typically, the antennas in an access point are monopole antennas due to the size constraints of fitting multiple antennas under the radome of the access point. In order to accommodate dual-band standards, monopole antennas designs are typically designed with two additional monopole elements. In general, three monopoles sharing the same ground plane incur a relatively large amount of ripple and pattern irregularity, especially as the spacing between the elements decreases. These are challenges presented when the principal currents exist on the monopole and on the ground plane.

DESCRIPTION OF EXAMPLE EMBODIMENTS

Overview

A microwave antenna assembly comprises a substrate with a first face and an opposing second face. The assembly also comprises at least one antenna disposed on the first face of the substrate and a balun disposed on the second face of the substrate. A first microstrip, disposed on the first face is coupled to the at least one antenna. A second microstrip, disposed on the first face, is coupled a feed line. A coplanar strip disposed on the second face is electrically coupled to the second microstrip and electromagnetically coupled to the first microstrip.

Example Embodiments

A dual-band printed omnidirectional antenna is presented herein that integrates several microwave constructs in a single piece of hardware. The antenna achieves a very wide bandwidth in upper (e.g., 5-6 GHz) and lower (e.g., 2.4-2.5 GHz) frequency bands, while providing omnidirectional coverage throughout the intended space. The antenna comprises three line transitions: coaxial to microstrip, microstrip to coplanar strip, and coplanar strip to microstrip. Small, yet efficient omnidirectional elements utilize tapering to enhance the impedance bandwidth and optimize the 5 GHz elevation plane patterns. A simple feed mechanism shortens the lengths of the microstrip traces used to feed the individual elements. These elements allow for the adoption of a lossier substrate, which reduces the cost of the overall antenna.

Figure 1:
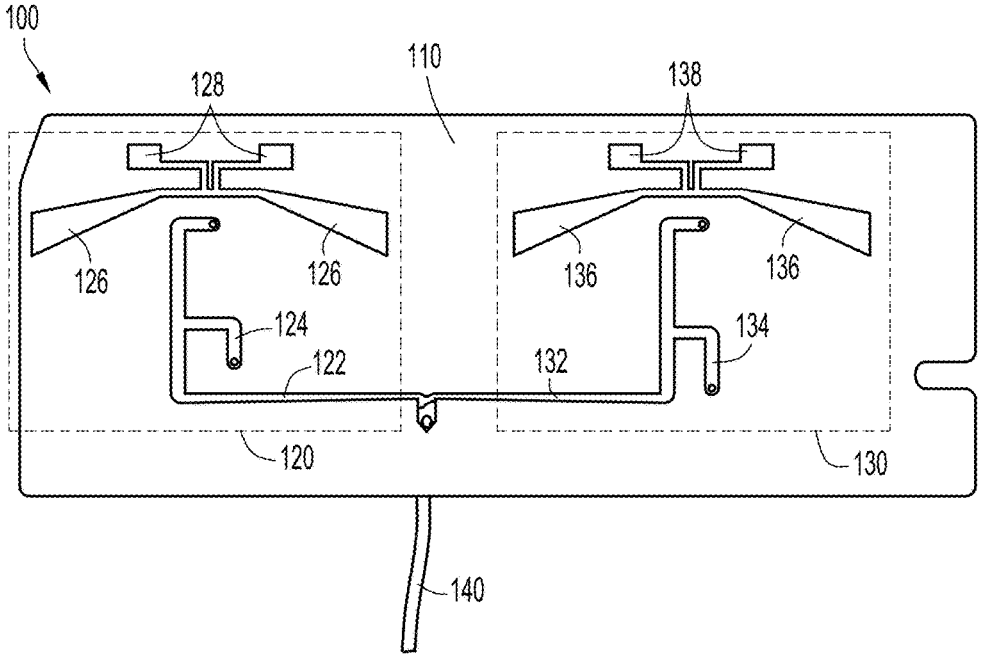
FIG. 1 illustrates the front face of a printed circuit board with two dual-band antenna elements according to an example embodiment.

Referring to FIG. 1, the front face 110 of one example embodiment of a dual-band printed antenna assembly 100 is described. There are two antenna elements 120 and 130 in the antenna assembly. Antenna element 120 comprises microstrip 122, shunt stub 124, lower band dipole 126, and upper band dipole 128. Similarly, antenna element 130 comprises microstrip 132, shunt stub 134, lower band dipole 136, and upper band dipole 138. Coaxial cable 140 serves as a feed line to the antenna assembly. In one example, coaxial cable 140 is connected to a 50 Ω microstrip line that splits to microstrip lines 122 and 132. Microstrip lines 122 and 132 may begin at the feed line as 100 Ω microstrip lines and taper linearly back to 50 Ω microstrip line over an approximately one inch long run. In one example, this run is nearly a half-wavelength at the lower operating band (e.g., 2.45 GHz) in the dielectric of the substrate, and the reflection coefficient looking into the tapering line section is small. Using microstrip lines 122 and 132, antenna elements 120 and 130 may be fed in-phase, forming a stacked dipole configuration. This configuration increases the power radiated/received in the plane around the antenna.

Figure 2:
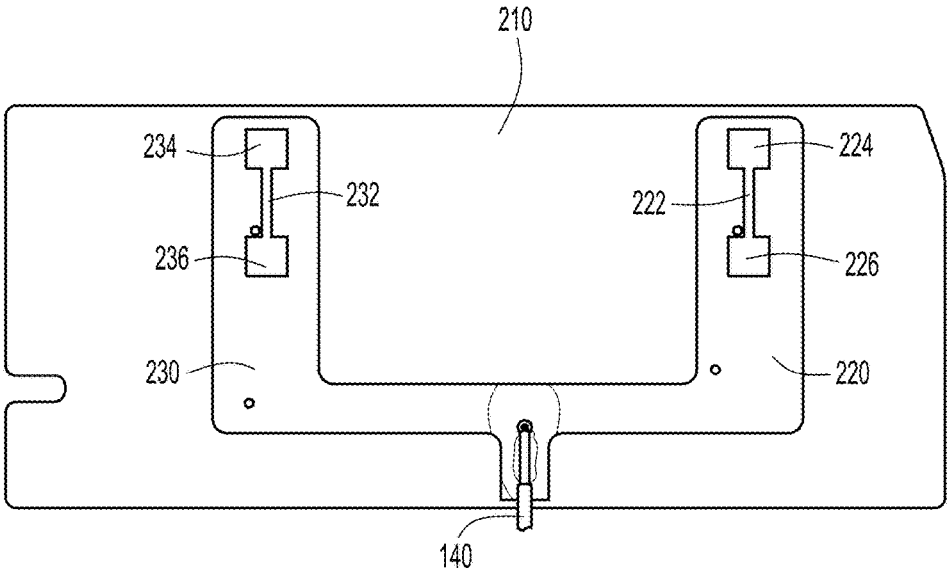
FIG. 2 illustrates the rear face of a printed circuit board with ground planes for the two dual-band antenna elements according to an example embodiment.

Referring now to FIG. 2, the rear face 210 of the dual band printed antenna assembly 100 is described. Balun/ground plane 220 is disposed on the rear face opposite antenna element 120. Coplanar strip 222 is formed opposite the radiating elements of antenna element 120, and is defined from ground plane 220 by cut-outs 224 and 226. Similarly, balun/ground plane 230 is disposed on rear face opposite antenna element 130. Coplanar strip 232 is formed opposite the radiating elements of antenna element 130, and is defined by cut-outs 234 and 236.

Figure 3:
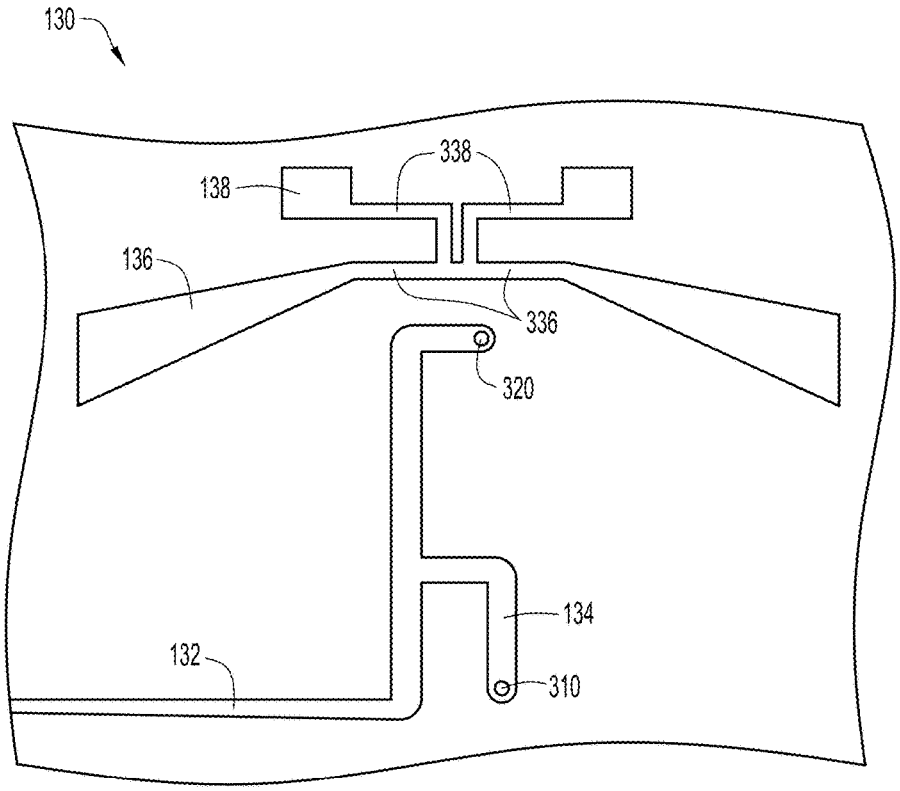
FIGS. 3 and 4 show enlarged views, of the front face and rear face, respectively, of one dual-band antenna according to an example embodiment.

Referring now to FIG. 3, an enlarged view of antenna element 130 is described. Microstrip 132 brings the signal from the feed line into the antenna element 130. Shunt stub 134 comes off of microstrip 132 and is electrically coupled to the ground plane by metallic via 310 through the substrate. Microstrip 132 continues toward the radiating elements and is electrically coupled to one end of coplanar strip 232 by metallic via 320 through the substrate. Microstrips 336 and 338 electromagnetically couple to the coplanar strip 232 through the dielectric of the substrate. Microstrip 336 sends the signal to the lower band radiating element 136 and microstrip 338 sends the signal to the upper band radiating element 138. In some examples, upper band dipole 138 may also radiate some of the signal in the lower frequency band.

In one example, the arms of the dipole element 136 may be tapered so that the resonant frequency of the antenna may be lowered without compromising the existing impedance bandwidth. Dipole tapers are an effective way to reduce the resonant frequency of an antenna without jeopardizing the radiation beamwidth or radiation efficiency. As the taper width increases, the Q-factor and resonant frequency of the antenna decrease. The arms may also be tapered away from the dipole element 138 so that the elevation plane patterns in the upper frequency band are not perturbed. In this example, tapering the arms of the dipole element may involve making the arms narrower at one end and wider at the other end of each arm. Additionally, tapering the arms of the lower dipole 136 away from the upper dipole 138 may involve printing the lower dipole 136 such that the free ends of the arms are further away from dipole 138 than the feed ends of the dipole arms.

Figure 4:
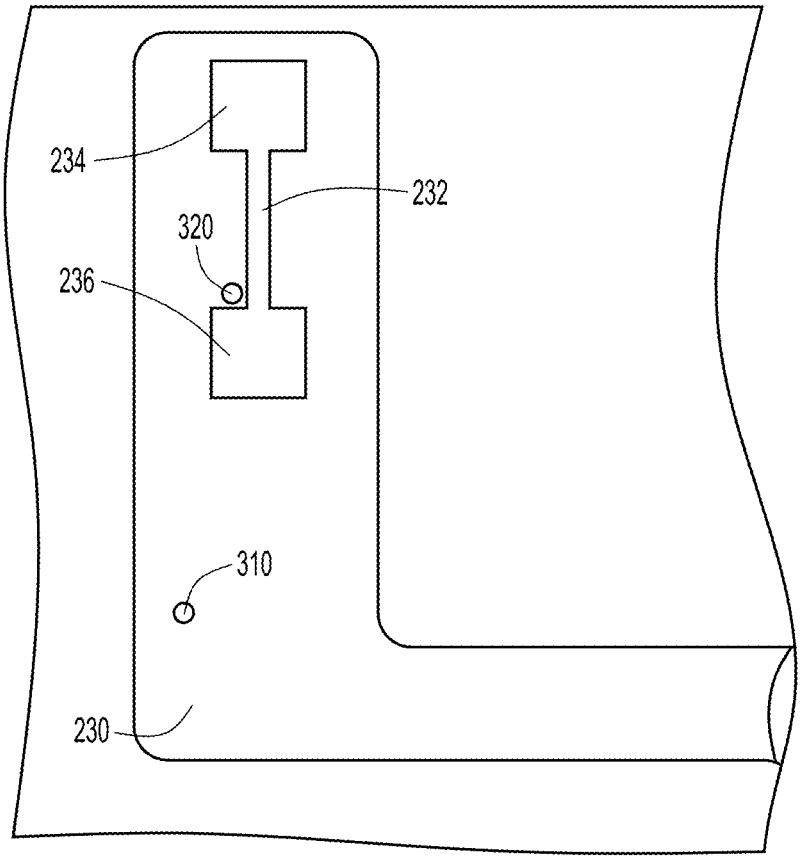

Referring now to FIG. 4, an enlarged view of the rear face of the substrate under antenna element 130 is described. Ground plane 230 is electrically coupled to the shunt stub 134 by metallic via 310. Coplanar strip 232 is defined by the cut-outs 234 and 236, and is electrically coupled to microstrip 132 through via 320. Coplanar strip is also electromagnetically coupled to microstrip 336 and microstrip 338. The cut-outs 234 and 236 enforce open-circuit conditions on the coplanar strip 232. As the signal wave propagates along the coplanar strip 232, from the via 320 toward the cut-out 236, the electric field's dominant vector component is in the direction of the length of the dipoles. This is because the potential is ground on the side of coplanar strip 232 opposite via 320. The electric field induces a current in microstrip 336 and microstrip 338, and that current propagates up (or down) dipole 126 and dipole 128. The axially-directed current sets up a time-dependent magnetic field that in turn produces a time-dependent electric field, and the combination of the two fields oscillating in phase produces an outward travelling wave. Because the current travels predominantly along the length of the dipoles, the omnidirectional radiation mode is preserved.

As used herein, "electrically coupled" is used to mean that there is a direct physical conduction path for a signal to travel between two elements. For example, metallic via 320 provides a direct, physical, metallic path between microstrip 132 and coplanar strip 232. In contrast, as used herein, "electromagnetically coupled" is used to mean that there is no direct conduction path, but a signal may travel by inductive or capacitive coupling through a dielectric. For example, coplanar strip 232 is electromagnetically coupled to microstrip 336 and microstrip 338 through the dielectric of the substrate.

Figure 5A:
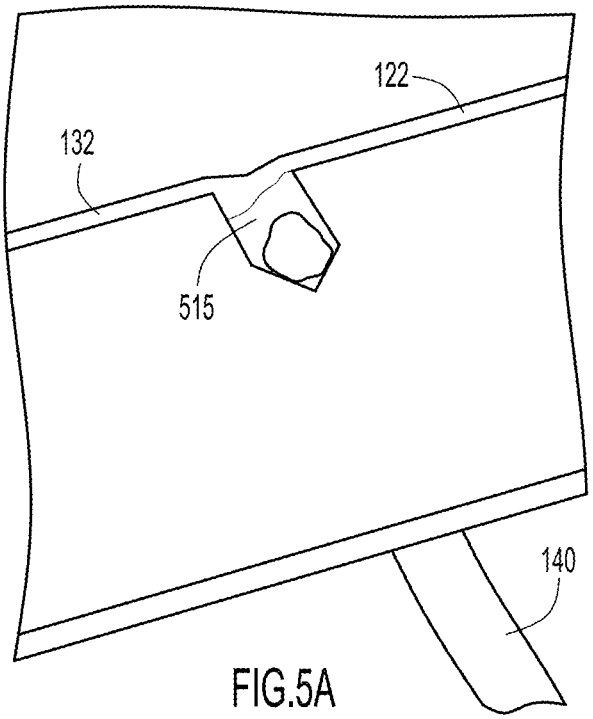
FIGS. 5A and 5B show an enlarged view, of the front face and the rear face, respectively, of the connection from the feed line to the printed circuit board according to an example embodiment.
Figure 5B:
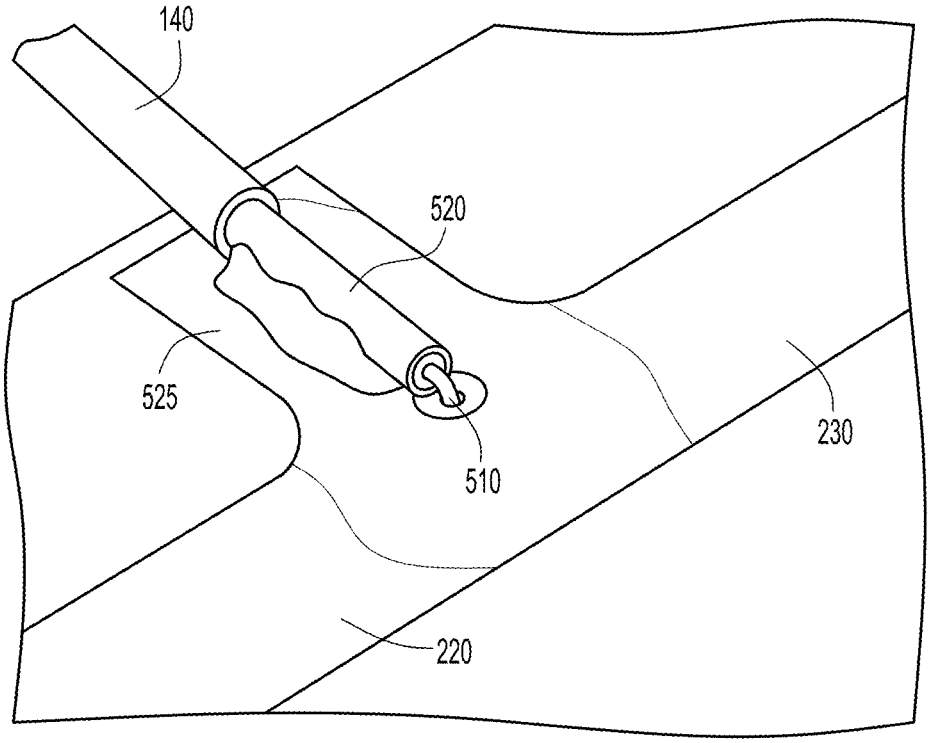

Referring now to FIGS. 5A and 5B, the connection between the coaxial feed line and the printed microstrips is shown. Coaxial feed line comprises a center conductor 510 coupled to pad 515 and a braided outer conductor 520 coupled to pad 525. In one example, coaxial feed line 140 comprises a stripped 1.32 mm diameter cable terminated in a micro coaxial (MCX) connector that couples to a radio. The stripped end may have 6 mm of the braid 520 exposed, 0.2 mm of the dielectric exposed, and a pre-bent and tinned 1.5 mm run of center conductor 510 exposed. The braid 520 is soldered directly to the pad 525 between ground planes 220 and 230, as shown in FIG. 5B. The pad 525 may be dimensioned so that all 6 mm of exposed braid 520 can be soldered to the pad 525 to ensure a reliable physical connection. The pre-bent center conductor 510 may be run through a hole in the substrate, and soldered to the pad 515 on the front face of the substrate. The pad 515 may be a relatively small V-shaped pad that allows the solder to collect locally on the pad 515 rather than bleed out onto the 100 Ω ends of microstrip lines 122 and 132. The pad 515 is kept small to minimize any shunt capacitance at the input, and quickly transitions to a 50 Ω microstrip that then splits into the 100 Ω ends of microstrip lines 122 and 132.

Figure 6A:
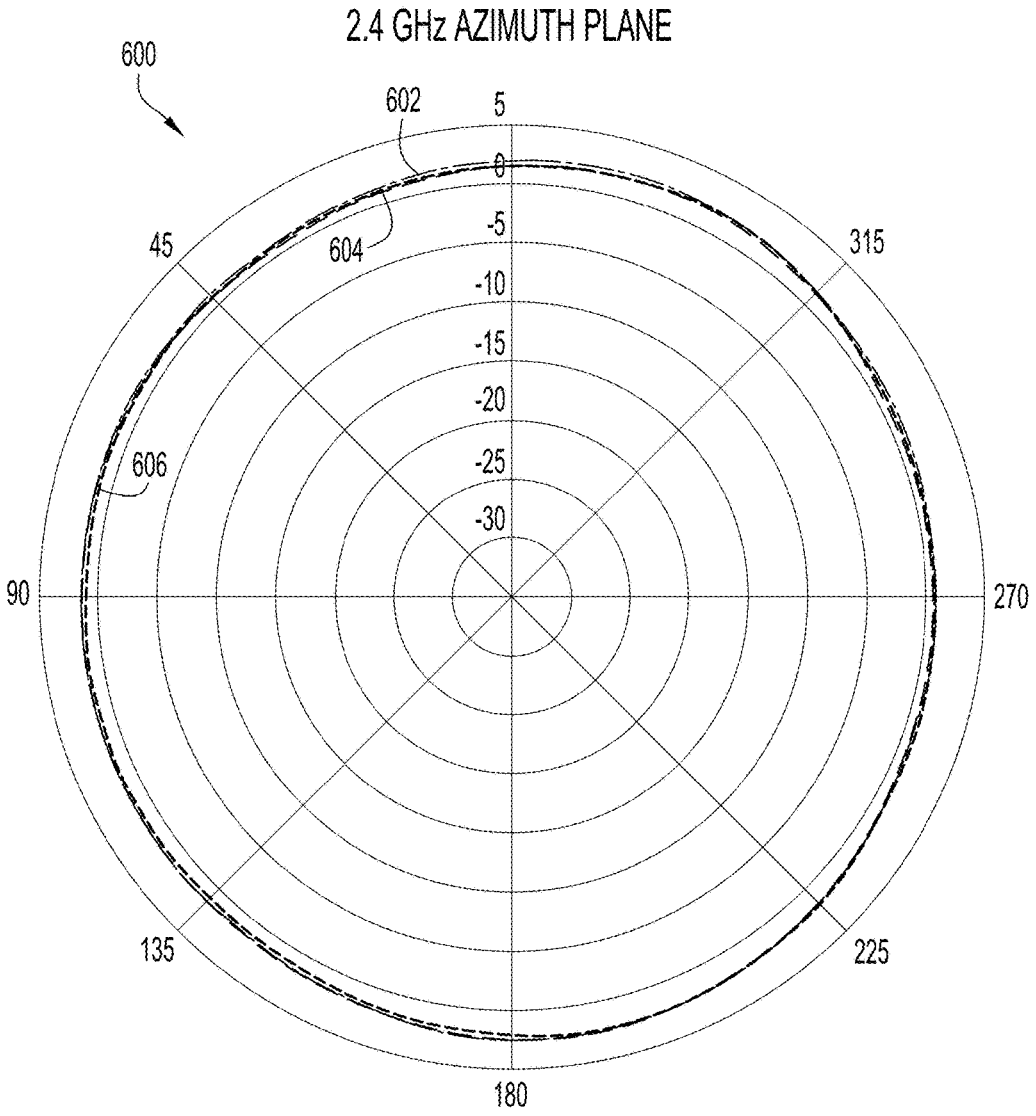
FIGS. 6A, 6B, and 6C illustrate the performance of the dual-band antenna in a frequency band centered at approximately 2.4 GHz, according to an example embodiment.
Figure 6B:
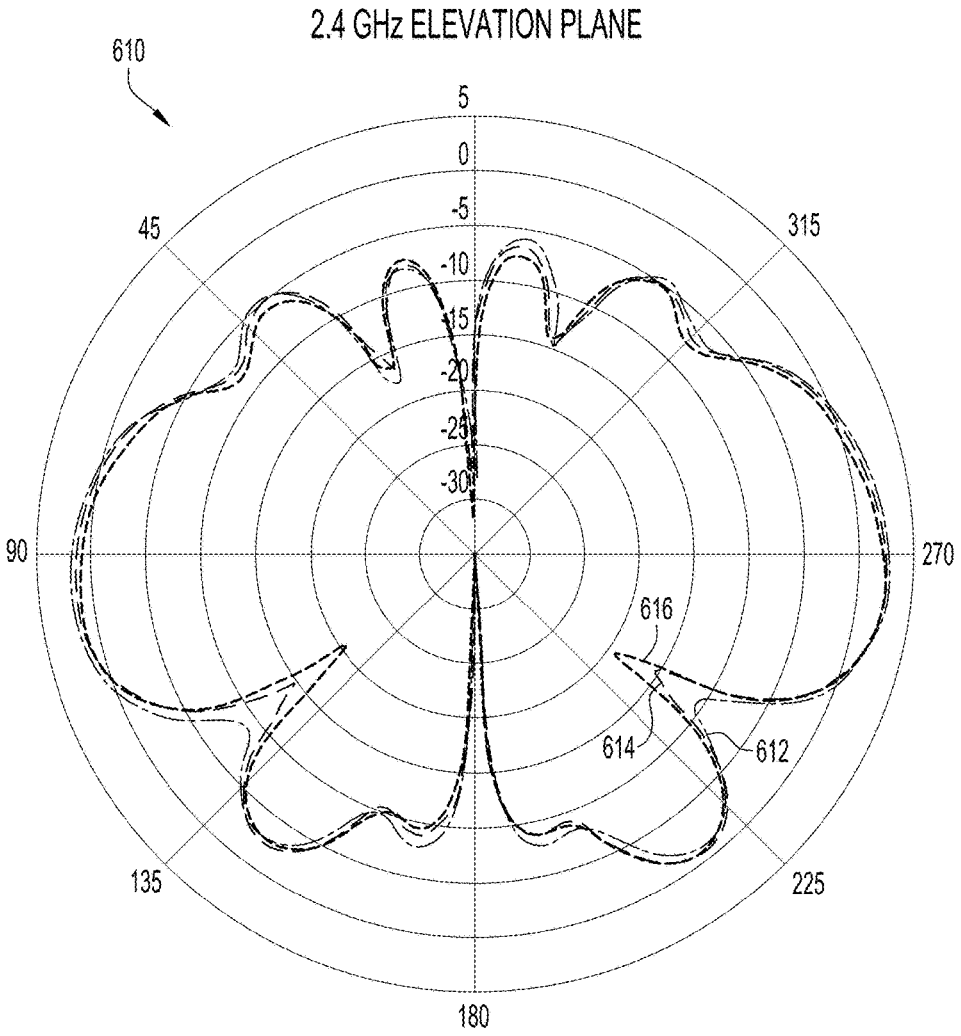
Figure 6C:
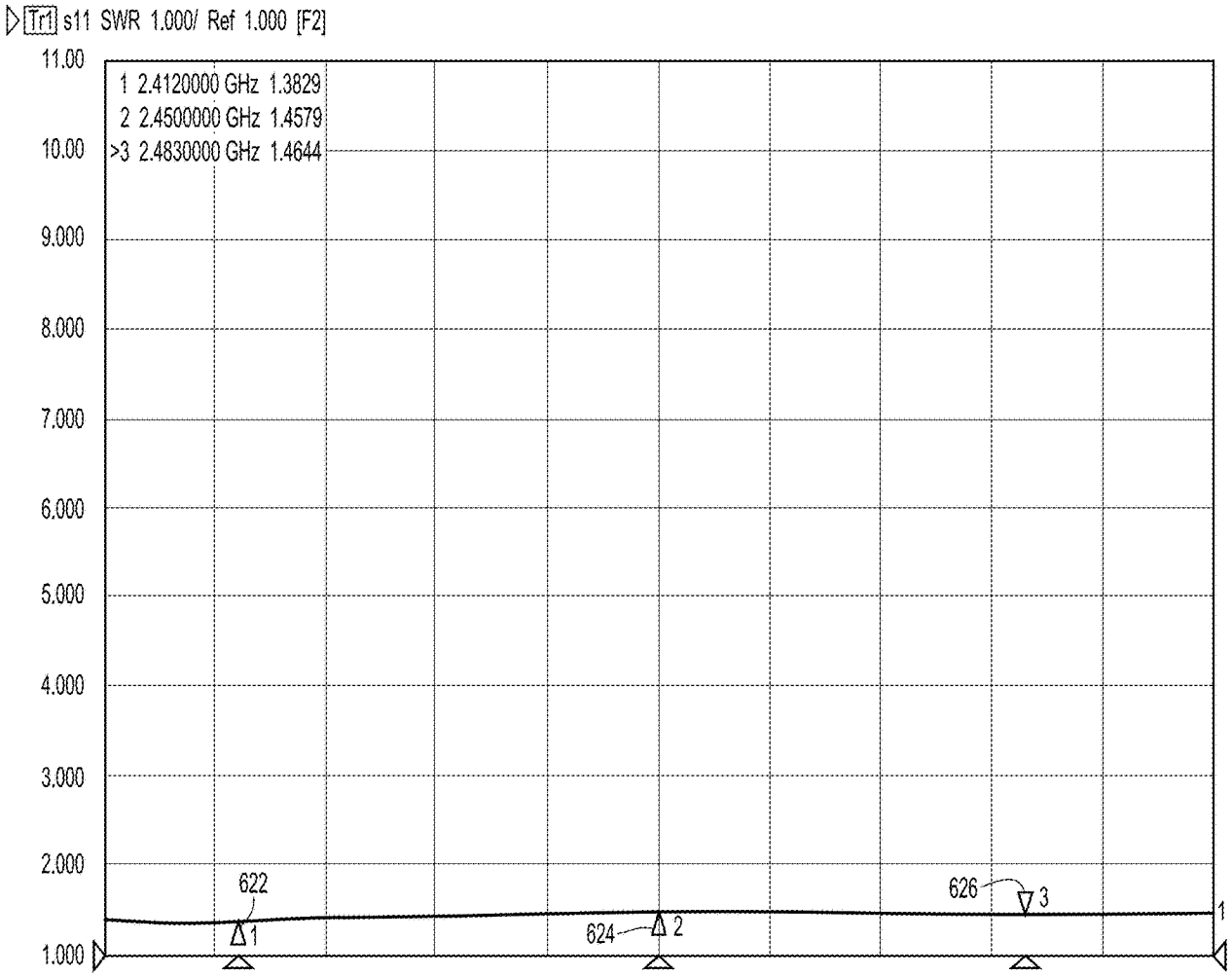

Referring now to FIGS. 6A, 6B, and 6C, the performance of the printed antenna in the lower frequency band is described. FIG. 6A shows a graph 600 of the power radiated in the azimuthal plane. Plots 602, 604, and 606 show the power radiated at 2.4 GHz, 2.45 GHz, and 2.5 GHz, respectively. All of the plots 602, 604, and 606 show that the power is radiated substantially omnidirectionally in the lower frequency band.

FIG. 6B shows a graph 610 of the power radiated in the elevation plane. Plots 612, 614, and 616 show the power radiated at 2.4 GHz, 2.45 GHz, and 2.5 GHz, respectively.

FIG. 6C shows a graph 620 of the Voltage Standing Wave Ratio (VSWR) of the antenna as a function of frequency in the lower frequency band. Points 622, 624, and 626 are marked to highlight the VSWR at specific frequencies. Point 622 shows that the antenna has a VSWR of 1.3829 at 2.412 GHz. Point 624 shows that the antenna has a VSWR of 1.4579 at 2.45 GHz. Point 622 shows that the antenna has a VSWR of 1.4644 at 2.483 GHz.

Figure 7A:
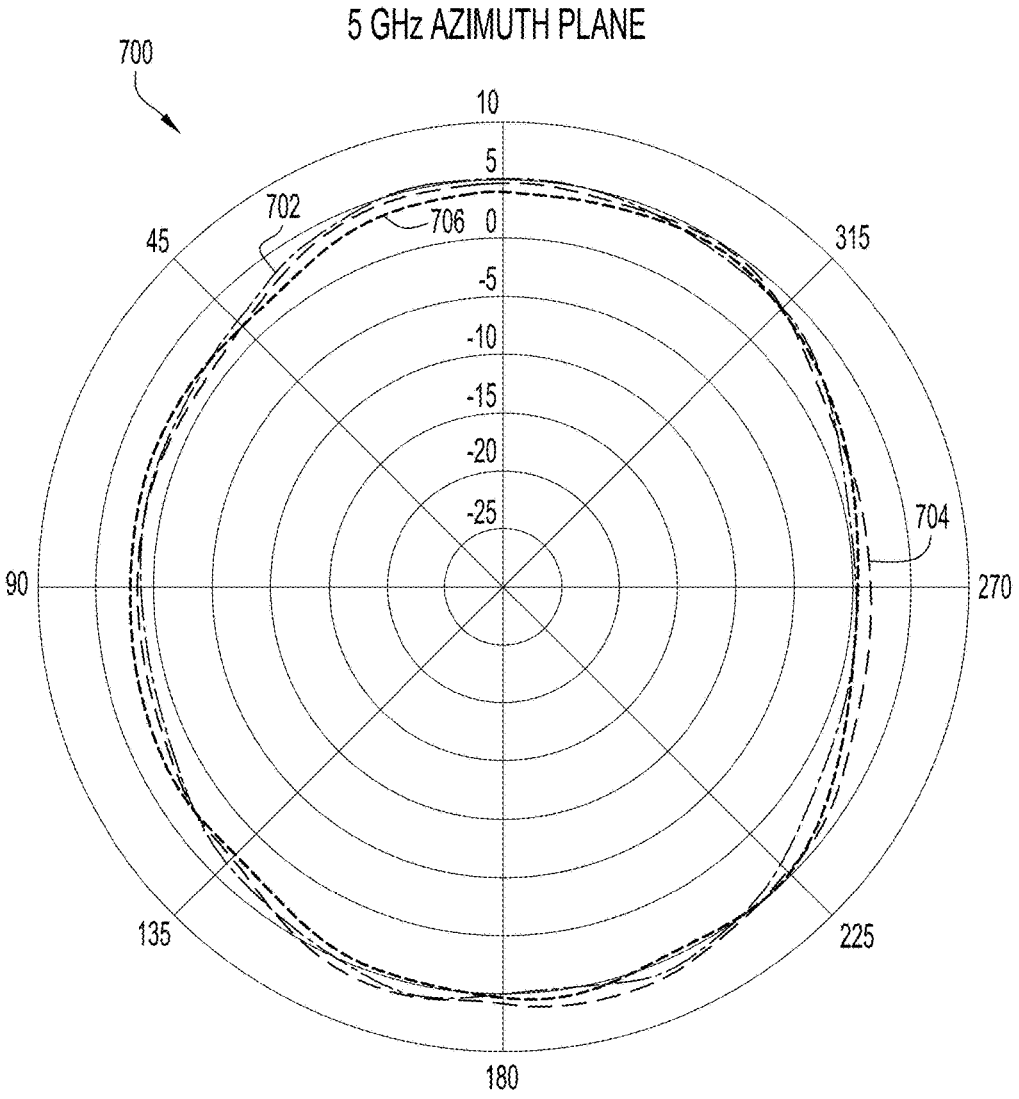
FIGS. 7A, 7B, and 7C illustrate the performance of the dual-band antenna in a frequency band centered at approximately 5 GHz, according to an example embodiment.
Figure 7B:
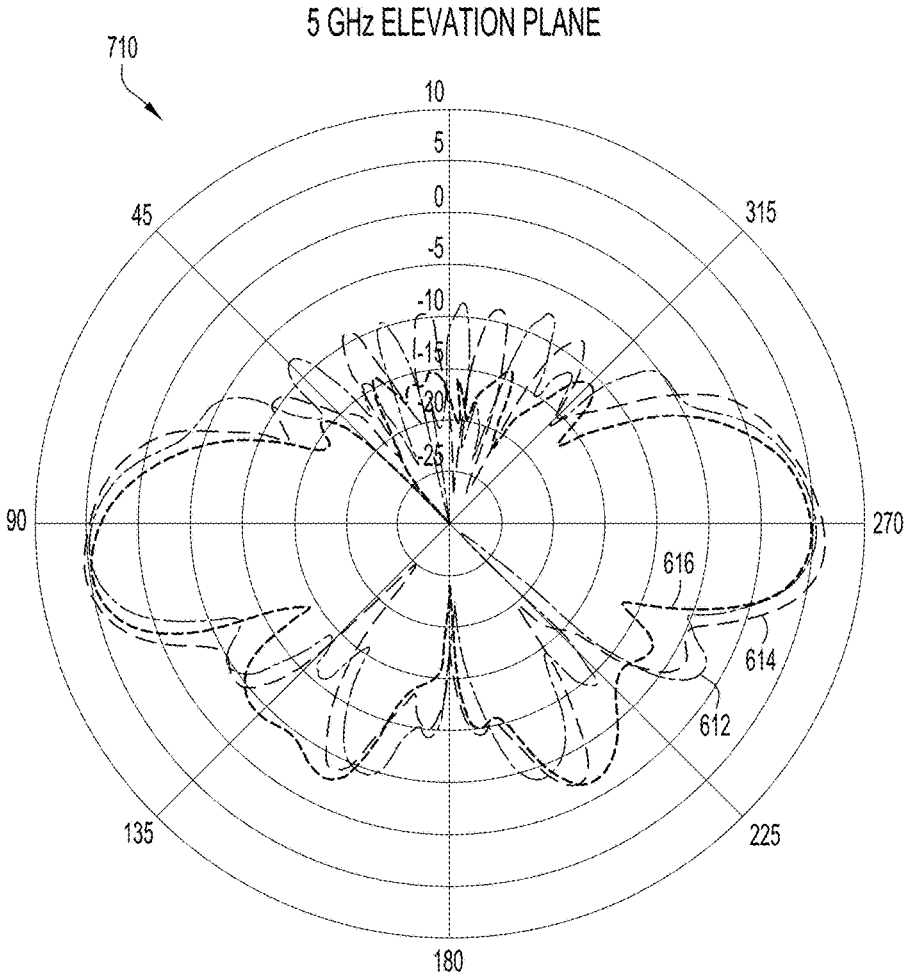
Figure 7C:
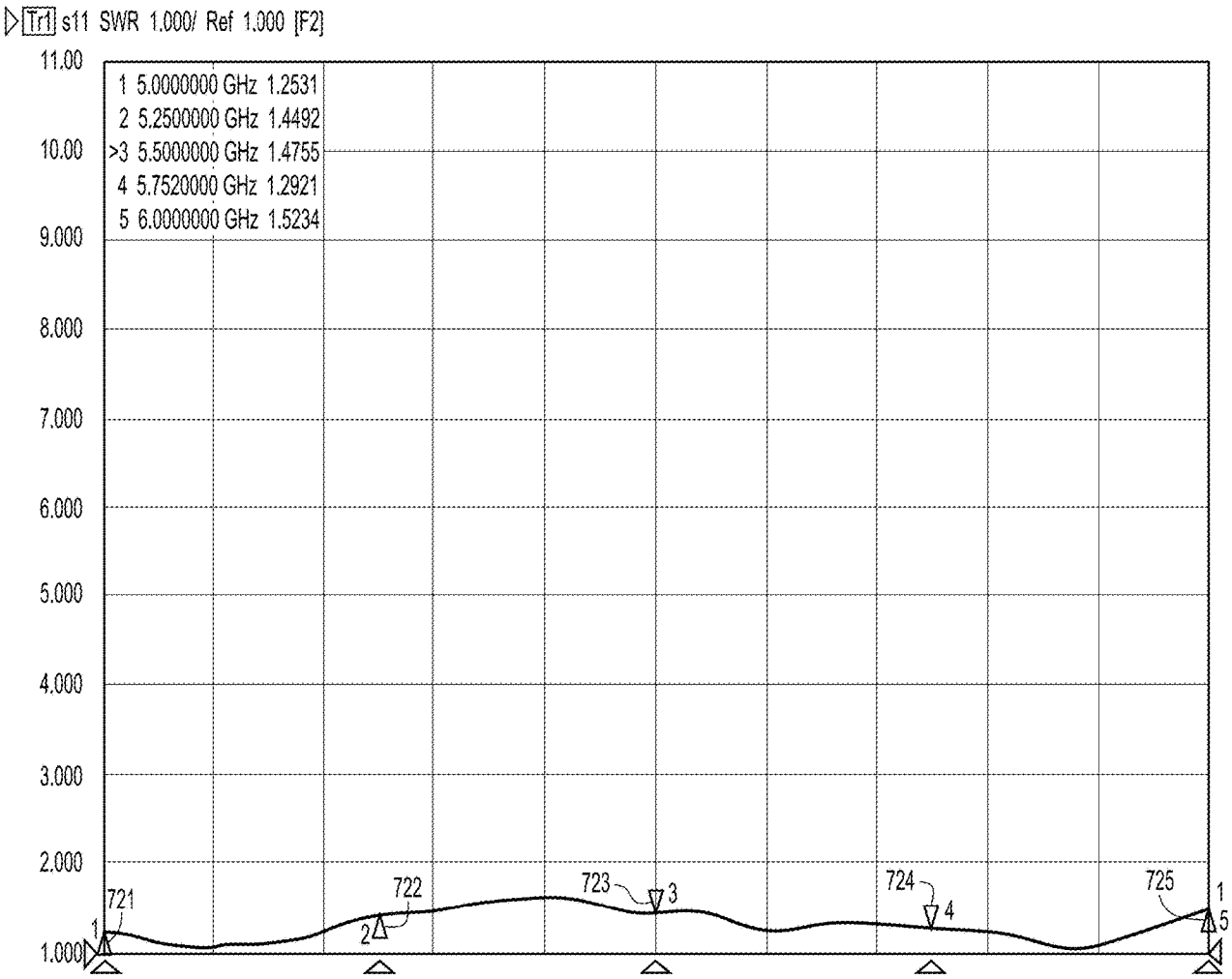

Referring now to FIGS. 7A, 7B, and 7C, the performance of the printed antenna in the higher frequency band is described. FIG. 7A shows a graph 700 of the power radiated in the azimuthal plane. Plots 702, 704, and 706 show the power radiated at 5.15 GHz, 5.5 GHz, and 5.85 GHz, respectively. All of the plots 702, 704, and 706 show that the power is radiated fairly omnidirectionally in the lower frequency band, with less than a 5 dB difference in radiated power.

FIG. 7B shows a graph 710 of the power radiated in the elevation plane. Plots 712, 714, and 716 show the power radiated at 5.15 GHz, 5.5 GHz, and 5.85 GHz, respectively.

FIG. 7C shows a graph 720 of the VSWR of the antenna as a function of frequency in the higher frequency band. Points 721, 722, 723, 724, and 725 are marked to highlight the VSWR at specific frequencies. Point 721 shows that the antenna has a VSWR of 1.2531 at 5 GHz. Point 722 shows that the antenna has a VSWR of 1.4492 at 5.25 GHz. Point 723 shows that the antenna has a VSWR of 1.4755 at 5.5 GHz. Point 724 shows that the antenna has a VSWR of 1.2921 at 5.75 GHz. Point 721 shows that the antenna has a VSWR of 1.5234 at 6 GHz.

Figure 8:
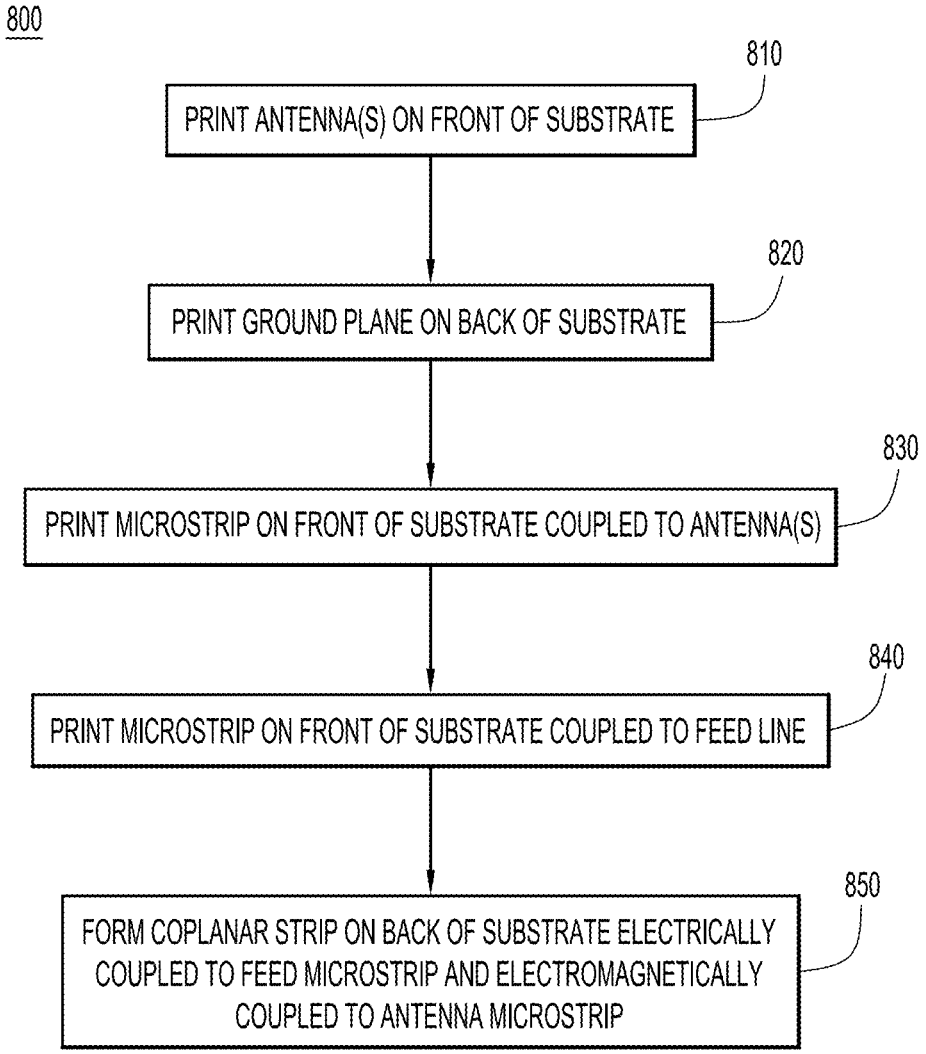
FIG. 8 is a flow chart depicting an example process for manufacturing the dual-band antenna according to an example embodiment.

Referring now to FIG. 8, an example process 800 of manufacturing the antenna is described. In step 810, dipole antennas are printed on the front face of a substrate made from a dielectric material, such as 28 mil EM-888. In step 820, a ground plane is printed on the back face of the substrate. One set of microstrips is printed, at step 830, on the front face of the substrate. This set of microstrips is electrically coupled to the printed dipole antennas. In step 840, another microstrip is printed on the front face of the substrate and electrically coupled to a feed line. On the rear face of the substrate, at step 850, a coplanar strip is formed that is electrically coupled to the feed line microstrip and electromagnetically coupled to the antennas microstrip. In one example, the coplanar strip is bounded on either end by cut-outs in the ground plane that enforce open circuit conditions on the coplanar strip.

In one example, the steps of process 800 may be combined or performed in any order. For example, all of the features on the front face of the substrate may be printed at substantially the same time, and all of the features on the rear face of the substrate may be printed at the same time. Additionally, the features may be printed by additive methods. In other words, a pattern may mask the substrate in areas that are not designated to be printed and a metallic coating is deposited over the mask and substrate. When the mask is subsequently removed, the metallic coating remains on substrate in the pattern of the feature. Alternatively, the features may be printed with subtractive means by depositing a metallic coating over the entire substrate, masking the pattern of the features, and etching away the metallic coating that is not covered by the mask.

The effective permittivity of a dipole is less than the effective permittivity of a patch antenna. The consequence of this is that a half-wavelength printed dipole does not undergo a significant reduction in size when loaded on a thin, low relative permittivity substrate. Therefore, the dipole may be designed as short as possible under the constraint that the omnidirectional radiation mode is preserved. In one example, the lower band dipole may be approximately a quarter wavelength at 2.45 GHz. The spacing between the elements may be a little less than a half wavelength at 2.45 GHz. The upper band dipole may be slightly greater than a quarter wavelength at 5.5 GHz, similar to the lower band dipole. Tapering the arms of the lower band dipole extends the current path, and may reduce the lower band resonant frequency of the lower band dipole. However, this may not be enough to produce a 50 Ω resonance at 2.45 GHz. The length of the dipole and the taper may be modified so that the input impedance looking into the element is such that the shunt stub matches the antenna to the 50 Ω characteristic impedance line. Additionally, since the shunt stub is effectively a shunt inductor at microwave frequencies, the high impedance shunt inductor has little effect on the microwave signal, and it passes to the dipoles to be radiated.

In one example, one antenna element may be raised from the edge of the substrate to accommodate a mounting structure that fastens the antenna to a ground plane and minimizes the capacitive relationship between the ground plane and the nearby element. In another example, four of the cards with printed dual-band antennas may be grouped under the same radome to support an access point with 4×4:3 MIMO functionality.

In summary, the dual-band printed omnidirectional antenna presented herein combines printed dipole antennas with printed circuitry to feed the antennas. The dipole antennas alleviate the strong ground plane dependence of monopole antenna designs, suppresses the diffracted contribution in the radiated pattern, and reduces the pattern ripple (i.e., improves the pattern uniformity), at the expense of larger antenna elements. The use of stacked dipole antennas also improves gain which in turn improves range.

In one example, an apparatus is provided comprising a substrate with a first face and an opposing second face. At least one antenna is disposed on the first face of the substrate and a balun is disposed on the second face of the substrate. A first microstrip, disposed on the first face is coupled to the at least one antenna. A second microstrip, disposed on the first face is coupled to a feed line. A coplanar strip disposed on the second face is electrically coupled to the second microstrip and electromagnetically coupled to the first microstrip.

In another example, a method is provided for manufacturing an antenna board. The method comprises printing at least one antenna on a first face of a substrate, and printing a balun on a second face of the substrate opposite the first face of the substrate. On the first face, a first microstrip is printed that is coupled to the at least one antenna, and a second microstrip is printed on the first face, which second microstrip is coupled to a feed line. The method further comprises forming a coplanar strip on the second face. The coplanar strip is electrically coupled to the second microstrip and electromagnetically coupled to the first microstrip.

In a further example, an apparatus is provided comprising a substrate, a first dipole antenna and a second dipole antenna disposed on a first face of the substrate. The second dipole antenna is tapered away from the first dipole antenna.

The above description is intended by way of example only. Any material described is only an example of a material that may be used. Other materials can be substituted without leaving the scope of the present invention. It is also to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

What is claimed is:

1. An apparatus comprising:

a substrate having a first face and an opposing second face;

at least one antenna disposed on the first face of the substrate;

a balun disposed on the second face of the substrate;

a first microstrip disposed on the first face and coupled to the at least one antenna;

a second microstrip disposed on the first face and coupled to a feed line;

a coplanar strip disposed on the second face, the coplanar strip comprising a first metallic portion electrically coupled to the second microstrip by a direct conduction path, a second metallic portion electrically coupled to the balun, and a slot separating the first metallic portion from the second metallic portion, wherein the coplanar strip is electromagnetically coupled to first microstrip; and voids in the balun that are wider than the slot of the coplanar strip on opposite ends of the coplanar strip, wherein the voids enforce open circuit conditions of the opposite ends of the coplanar strip.

2. The apparatus of claim 1, further comprising a shunt stub disposed on the first face, the shunt stub coupling the second microstrip to the balun by a via through the substrate.

3. The apparatus of claim 2, wherein the shunt stub is placed on the first face to produce a 50Ω impedance match at the feed line.

4. The apparatus of claim 1, wherein the direct conduction path electrically coupling the coplanar strip to the second microstrip comprises a via through the substrate.

5. The apparatus of claim 1, wherein the at least one antenna comprises at least one dipole antenna.

6. The apparatus of claim 5, wherein the at least one dipole antenna comprises a first dipole antenna tuned to a first frequency band centered at approximately 5.5 GHz and a second dipole antenna tuned to a second frequency band centered at approximately 2.45 GHz.

7. The apparatus of claim 6, wherein the second dipole antenna is tapered away from the first dipole antenna.

8. The apparatus of claim 1, wherein the feed line comprises a coaxial cable coupled to the balun and the second microstrip.

9. The apparatus of claim 1, further comprising:

a second coplanar strip disposed on the second face and electrically coupled to the second microstrip; and at least one other antenna disposed on the first face and electromagnetically coupled to the second coplanar strip.

10. A method comprising:

printing at least one antenna on a first face of a substrate;

printing a balun on a second face of the substrate opposite the first face of the substrate;

printing a first microstrip on the first face, the first microstrip coupled to the at least one antenna;

printing a second microstrip on the first face, the second microstrip coupled to a feed line; and forming a coplanar strip on the second face, the coplanar strip comprising a first metallic portion electrically coupled to the second microstrip by a direct conduction path, a second metallic portion electrically coupled to the balun, and a slot separating the first metallic portion from the second metallic portion, wherein the coplanar strip is electromagnetically coupled to the first microstrip, wherein printing the balun comprises printing a balun pattern including voids that are wider than the slot of the coplanar strip on opposing ends of the coplanar strip, wherein the voids enforce open circuit conditions on the opposing ends of the coplanar strip.

11. The method of claim 10, further comprising forming a shunt stub on the first face, the shunt stub coupling the second microstrip to the balun by a via formed in the substrate.

12. The method of claim 10, further comprising forming a via in the substrate and coupling the second microstrip to the coplanar strip through the via.

13. The method of claim 10, wherein printing the at least one antenna comprises printing a first dipole antenna and printing a second dipole antenna.

14. The method of claim 13, wherein printing the second dipole antenna comprises printing the second dipole antenna tapering away from the first dipole antenna.

* * * * *